United States Patent [19]

Schultz

[11] Patent Number: 4,756,861

[45] Date of Patent: Jul. 12, 1988

[54] VIBRATORY CONCRETE PIPE FORMING APPARATUS AND METHOD

[76] Inventor: Ronald C. Schultz, 906 Clubview Blvd., Worthington, Ohio 43085

[21] Appl. No.: 948,097

[22] Filed: Dec. 31, 1986

[51] Int. Cl.[4] ..... B28B 21/16; B28B 21/28

[52] U.S. Cl. ..... 264/71; 264/312; 264/333; 425/3; 425/427; 425/429; 425/432

[58] Field of Search ..... 425/3, 262, 424, 426, 425/427, 432, 453, 456, 429; 264/22, 69, 71, 72, 312, 333

[56] References Cited

U.S. PATENT DOCUMENTS

| | | | |
|---|---|---|---|
| Re. 28,902 | 7/1976 | Trautner et al. | 425/262 |
| 3,500,514 | 3/1970 | Ruegsegger | 425/3 |
| 4,118,165 | 10/1978 | Christian | 425/262 |
| 4,197,074 | 4/1980 | Christian | 425/427 |
| 4,235,580 | 3/1981 | Christian | 425/427 |

FOREIGN PATENT DOCUMENTS

| | | | |
|---|---|---|---|
| 252892 | 2/1970 | U.S.S.R. | 425/456 |

*Primary Examiner*—Jay H. Woo
*Assistant Examiner*—James C. Housel
*Attorney, Agent, or Firm*—Mueller and Smith

[57] ABSTRACT

Disclosed is an improved packerhead or drycast concrete product forming apparatus and method for making a concrete product therewith. The apparatus typically includes a mold having a lower curing pallet, a platform for supporting said mold at the pallet, and a vibrator table having a vibrator ring for association with said curing pallet. The improved apparatus of the present invention preferably comprises a vibrator ring having selectively engageable (and disengageable) means to rigidly connect the vibrator ring to the curing pallet when said vibration means is activated. The preferred vibrator ring selectively engageable means comprises electromagnet means and the preferred product of the process comprises concrete pipe.

11 Claims, 2 Drawing Sheets

VIBRATORY CONCRETE PIPE FORMING APPARATUS AND METHOD

BACKGROUND OF THE INVENTION

The present invention relates to a vibratory packerhead or drycast concrete pipe-forming apparatus and more particularly to improving the transmission of the vibration affect from the vibrating means to the concrete in the mold.

Precast concrete products, such as, for example, non-reinforced or steel reinforced precast concrete pipe or tile, steel-reinforcd precast concrete manhole segments, steel-reinforced precast concrete box culvert segments, non-reinforced or steel-reinforced concrete catch basin structures, and the like typically are manufactured by machinery of various types which are designed and built to manufacture multiple units of like or similar shape and application in a single production run. These products fall into the broad class of concrete pipe products or typically are manufactured by factories whose primary product is concrete pipe. Typically, these precast concrete products are made from various Portland cement mixtures. In the manufacture of concrete pipe or tile, a variety of drycast or packerhead or roller head concrete pipe-forming machines are known. These machines utilize vibration, in whole or in part, as a means to consolidate or densify the cementitious mixture, and as a means to facilitate achievement of the desired concrete surface texture. Such machines can be found in U.S. Pats. Nos. 4,118,165, 4,197,074, 4,235,580, and Re. Pat. No. 28,902, the disclosure of which is incorporated expressly herein by reference.

The application of vibration to the cementitious mixture causes the mixture to assume a more plastic state during the vibration action, so that following the vibration procedure, the resulting vibrating product is in a more consolidated or dense state. Vibration additionally results in the finest components of the mixture or slurry being moved to the molded surfaces, thus achieving the desired surface texture. The effectiveness and efficiency of the vibrating action is dependent upon its application directly to the concrete mixture or to the mixture through a mold or machine component, in the frequency, impact, and amplitude appropriate for achieving the desired result.

Concrete pipe products typically have a tongue or male end and a socket or female end which is bell-shaped. Either end of the pipe product may be adapted to receive a gasket (e.g rubber or other suitable material) for the purpose of achieving a water-tight seal between sections of the pipe when joined. The surface texture and finish of the inner socket end (the surface formed by the upper vertical and horizontal surfaces of the curing pallet) must be adequately compacted to provide the compressive and tensile strength required to resist the force applied by forcing the gasketed end or ends in place. It also is important that the inner concrete surface of the socket end be smooth and void-free to facilitate a water-tight seal. One or both of these two critical conditions frequency are not attained due principally to the failure of the machinery to provide effective vibration during the pipe-forming process.

BROAD STATEMENT OF THE INVENTION

The present invention is directed to improving the concrete product, e.g. pipe, forming operation by providing an improved design of machine components which effect the vibration action during the pipe-forming process. Broadly, the present invention is directed to improving a packerhead or drycast concrete pipe-forming apparatus which includes a mold preferably having a lower curing pallet, a platform for supporting said mold at the pallet, and a vibrator table having a vibrator ring (vibrator transmission means) associative with said curing pallet. The improved apparatus of the present invention comprises the vibrator ring having selectively engageable means to rigidly connect the vibrator ring to the curing pallet. Such improved connection results in the desired vibration impact, frequency, and amplitude being effectively transmitted to the concrete mix during the pipe-forming process. The selectively engageable means is consistent with and compatible with the intended cycle of the apparatus in the pipe-forming process. The preferred selectively engageable (and disengageable) means comprises electromagnetic means disposed with said vibrator ring for selective engagement and disengagement with the curing pallet.

Another aspect of the present invention is an improved process for forming concrete pipe and like concrete products. In the improved process which employs the packerhead or drycast concrete pipe-forming apparatus described above, the vibrator ring is rigidly engaged with the curing pallet during the vibration sequence of the process for improving the transmission of frequency, amplitude, and impact of the vibratory function from the vibrating means to the concrete mix in the mold. The resulting concrete pipe product possesses, for example, improved compressive strength reduced water absorption properties, and a higher unit weight (density).

Advantages of the present invention include the ability to make an improved concrete pipe product. Another advantage is that implementation of the invention is readily achievable on existing machinery, yet can also be readily implemented in new machinery. Another advantage is that the invention can be practiced readily within existing machine operating parameters and protocol. These and other advantages will be apparent readily to those skilled in the art based upon the disclosure contained herein.

The drawings will be described in detail in connection with the description which follows.

DETAILED DESCRIPTION OF THE INVENTION

It long has been, and continues to be, common practice to design, build, and operate machinery for manufacturing a variety of concrete products which machinery includes vibration-transmitting chains of machine components or molds. These vibration transmitting chains invariably fail to provide sufficiently secure connections due to design difficulties of implementing and releasing those connections. Such insecure connections often transmit vibration of inadequate and/or improper frequency, amplitude, and/or impact to the concrete mixture. This results in difficulties and/or inconsistencies in achieving maximum, or at least adequate, concrete density or desired surface texture of the final product.

Accordingly, the present invention is based upon the recognition that the transmission of vibration through the machine components and mold to the concrete mixture will be most effective and efficient when the connection between these machine components is sufficiently secure to resist the full force of the vibration. Only then will the force, frequency, and amplitude of the vibration source be approximated when it reaches the concrete mixture. Then, the concrete density will be improved along with the strength of the resulting product while achieving a more desirable concrete surface texture. Adaptation of the present invention can be accomplished readily by adapting or retrofitting existing machinery, such as illustrated at FIG. 1.

Figure 1:
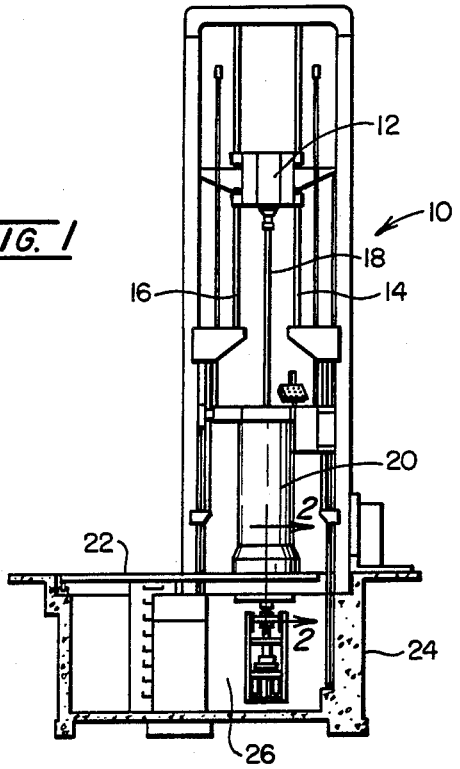
FIG. 1 is a front-elevational view showing a conventional concrete pipe-forming apparatus which has been adapted with the present invention.

The vibratory packerhead pipe machine depicted at FIG. 1 is like that machine described in Re. Pat. No. 28,902 which should be consulted for construction details. Generally, the packerhead machine has overhead frame superstructure 10 which bears movable carrier or cross-head drive mechanism 12 which supports the packerhead or roller head which is a circular powered series of compacting rollers and a trowel utilized in concrete pipe formation. Cross-head mechanism 12 rides on cross-head guides 14 and 16 with the packerhead (not shown in FIG. 1) being driven by drive shaft 18. The concrete conveyor, hopper and other equipment for operation of the packerhead machine will be apparent readily to those skilled in this art field.

Figure 2:
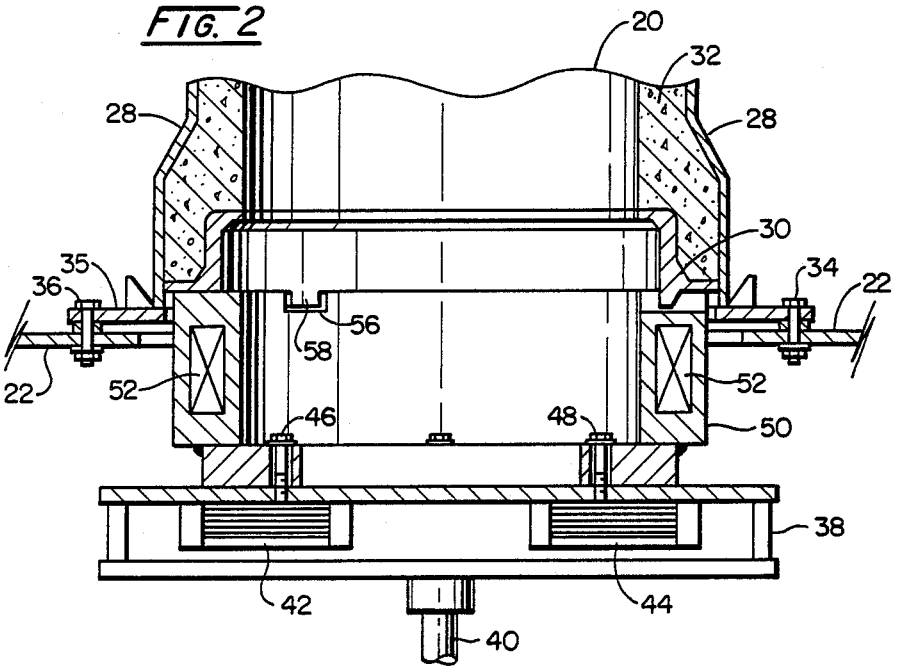
FIG. 2 is an exploded partial cross-sectional elevational view of FIG. 1 taken along line 2—2.

Mold assembly 20 is supported on indexing table 22 which surmounts pit 24. Disposed in pit 24 is mechanism 26 which provides vibration and usually rotation functions in the pipe forming process. Referring to FIG. 2 now, it will be observed that mold assembly 20 is composed of outer mold shell 28 and curing pallet or mold section 30 which forms the bell end or socket end of the concrete pipe. Concrete mixture 32 is seen to be disposed between outer mold 28 and curing pallet 30. Ring 35 is attached to indexing table 22 via bolts 34, 36, and others not shown. Finned ring 35 provides proper location of mold assembly 20 on table 22.

Vibrator table 38 is brought into position via rod 40 which is operated by a mechanism not shown in detail in the drawings. Vibrators 42 and 44 are affixed to vibrator table 38. Connected to table 38 by bolts 46, 48, and others not shown, is vibrator ring 50 which contains coil 52. Vibrator ring 50 has three drive recesses or slots, e.g. recess 56, for accommodating pallet legs, e.g. pallet leg 58 for recess 56, which pallet legs of curing pallet 30 provide the mechanism whereby rotation of pallet 30 may be accomplished via rod 40. The annular shape of vibrator ring 50 is conventional, though other shapes and designs may be appropriate with other machines and/or in making other concrete products.

When vibrators 42 and 44 are turned on, they supply vibration via vibrator ring 50 (vibration transmission means) to curing pallet 30 for vibration of mixture 32 within mold assembly 20. It will be observed that only gravitational and frictional forces cause curing pallet 30 to remain in tactile relationship with vibrator ring 50 in conventional machine designs. During the vibration operation, then, incomplete or inadequate impact, frequency, and amplitude of vibration is transmitted through this vibration chain from vibrators 42 and 44 to mixture 32. Accordingly, vibrator ring 50 illustrated at FIG. 2, and in more detail at FIG. 3, contains electromagnetic capability supplied via electrically-actuable coil 52 which is supplied power via cable 60. When the electromagnetic function is activated during the vibration sequence of the pipe forming operation, a rigid, firm connection between curing pallet 30 and vibrator ring 50 results. Thus, frequency, amplitude, and impact of the vibration operation is transmitted effectively and efficiently to mixture 32 housed within mold 20. Multiple coils disposed about vibrator ring 50 in regular or non-regular intervals also may be employed.

It will be observed that vibrator ring 50 bears three recesses, recesses 58, 62, and 64, for accommodating three pallet legs extending downwardly from curing pallet 30. Other machine designs may have none, 4, or 6 pallet legs. Such recesses in combination with the pallet legs enable mold assembly 20 and the mixture therein to be rotated by rotation of pallet 30 during the bell forming step of the pipe forming operation. Prototype vibrator ring 50 has holes 66–72 for its bolting onto vibrator table 38 at vibrator ring annulus 74. Annulus 76 contains non-magnetic material which separates the north/south annular poles formed when the coil disposed within vibrator ring 50 is actuated electrically. It will be appreciated that the electromagnet function disposed within vibrator ring 50 could be segmented (as set forth above) rather than a full ring magnet as is necessary, desirable, or convenient in accordance with conventional engineering routine and design.

Figure 4:
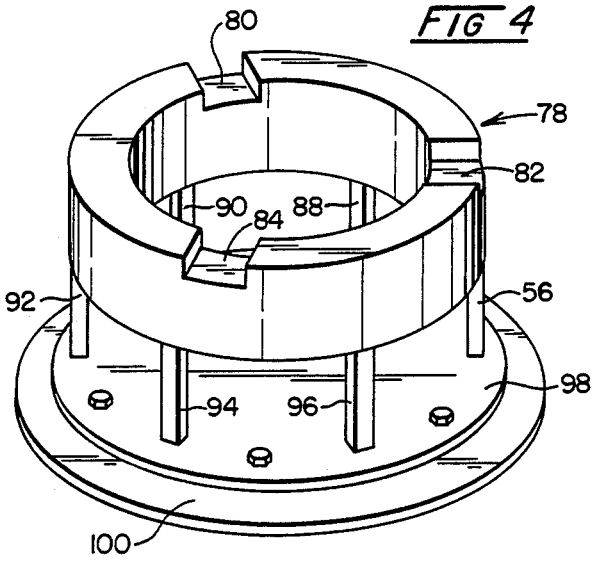
FIG. 4 is a perspective view of an alternative vibrator ring design.

An alternative and preferable configuration for the vibrator ring is depicted at FIG. 4 for vibrator ring 78. Vibrator ring 78 again has recesses or drive notches 80, 82, and 84 about its upper section and contains one or more electromagnets disposed therebetween. The upper annular section of vibrator ring 78 is supported on legs 86–96 which are welded or otherwise connected to ring plate 98. Ring plate 98 then is bolted onto the upper flat plate portion of vibrator table 100. The design of vibrator ring 78 disposed on a plurality of vertically disposed or upstanding legs facilitates removal of spillage more readily during the vibration or rotation (if used) steps of the process. Also, these legs enable workers to more readily access the area on ring plate 98 for removal of overflow concrete which accumulates during the pipe molding operation.

A distinct advantage of utilizing a magnetic connection for affixing vibrator ring 50 to curing pallet 30 involves the ability to detach such firm or rigid connection readily once the vibration sequence of the pipe forming operation is complete. The release must be accomplished in the manner consistent with and compatible to the intended machine cycle, and other existing machine components. For example, the vibration and rotation operations are conducted sequentially or concurrently as is the pipe forming process utilizing a plurality of molds on indexing table 22. The value of utilizing a magnetic connection includes its ready implementation into existing machinery and operating schedules with the minimum need for equipment replacement and redesign. Notwithstanding the preferred magnetic connection, it will be appreciated that other tactile, physical connection between curing pallet 30 and vibrator ring 50 can be envisioned, provided that they enable the effective and efficient transmission of vibration impact, amplitude, and frequency to the concrete mixture to occur, and provided they provide the requisite ready disconnection when the vibration operation has ceased. One conceivable way for accomplishing this connection is to enlarge the surface area of contact between the curing pallet and the vibrator ring, though specially-designed curing pallets and vibrator rings are needed for this purpose. In conventional machines, it should be understood that very little surface area of contact between the curing pallet and the vibrator ring is seen to exist. Increasing the surface area (e.g. such as the increased contact area of curing pallet 30 and vibrator ring 50) and angle of contact may provide sufficient effective transmission of vibration to concrete mixture 32 to improve the operation. Frictional fit of a ball-and-socket arrangement or other releasable mechanism also can be envisioned.

Figure 3:
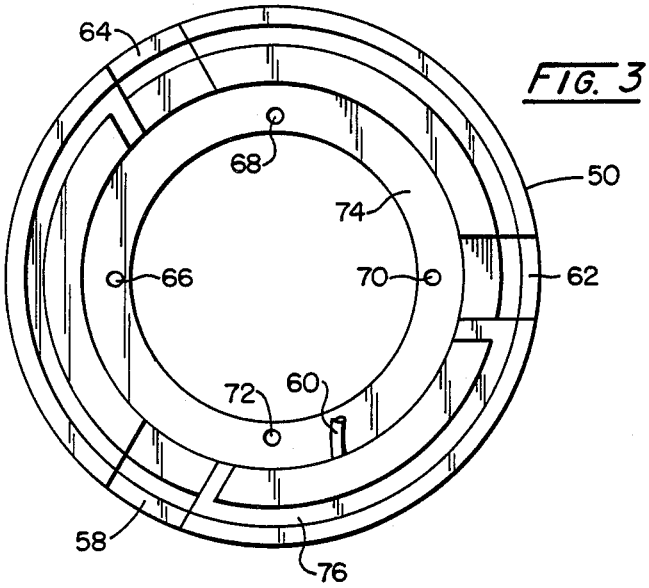
FIG. 3 is an overhead plan view of a prototype improved vibrator ring utilizing selectively engageable magnetic means for rigidly connecting it to the curing pallet.

With respect to the effectiveness of securing the curing pallet to the vibrator ring during the pipe forming operation, prototype vibrator ring 50 was utilized for production of concrete pipe samples which were subjected to testing. The pipe samples made were nominal 12 inch diameter concrete pipe with reinforcing bar therein. The samples made were essentially only at the bell end of the pipe since it is at this location that the vibration operation has its desired result. The wall thicknesses at the bell end were designed for about 4 inches. The first three samples were made utilizing the magnetic vibration ring as depicted at FIG. 3. Sample No. 1 was vibrated only for 25 seconds; Sample No. 2 was vibrated for 25 seconds and then troweled (the curing pallet/mold rotated) for 10 seconds; and Sample No. 3 was subjected to the same processing sequence as Sample No. 2, except that "dry" concrete spillage from the indexing table was used to make this sample. The next two samples were made utilizing a standard vibration ring without magnetic function or other means for rigidly connecting the vibrator ring to the curing pallet, Sample No. 4 being vibrated only for 25 seconds and Sample No. 5 being vibrated for 25 seconds and troweled for 10 seconds. After the concrete pipe samples were made, segments measuring about 6 inches were cut from each pipe sample and submitted for testing. Core samples from each of these segments were selected and subjected to concrete pipe compressive strength testing in accordance with ASTM C-497-82a, to concrete pipe water absorption testing, and to unit weight (density) measurements. The test results recorded are set forth in the following tables:

TABLE 1

COMPRESSIVE STRENGTH

| Sample No. | Core Sample Diameter (in) | Core Sample Length (in) | Core Sample Area (sq. in) | Test Load (lbs) | Test* Strength (psi) |
|---|---|---|---|---|---|
| 1 | 1.812 | 3.96 | 2.58 | 16,800 | 6,512 |
| 2 | 1.814 | 3.93 | 2.58 | 14,600 | 5,659 |
| 3 | 1.813 | 2.99 | 2.58 | 18,100 | 6,819 |
| 4 | 1,811 | 3.76 | 2.57 | 10,700 | 4,163 |
| 5 | 1.807 | 3.03 | 2.56 | 12,800 | 4,756 |

*ASTM Correction Factor of 0.972 for Sample No. 3 and O.974 for Sample No. 5.

TABLE 2

UNIT WEIGHT AND BOILING WATER ABSORPTION

| Sample No. | Dry Wt (lb) | Unit Wt (lb/ft$^3$) | Wt After 5 hr Boil | Weight Increase (lb) | % Water Absorption |
|---|---|---|---|---|---|
| 1 | 9.15 | 148 | 9.55 | 0.40 | 4.4 |
| 2 | 10.10 | 145 | 10.55 | 0.40 | 4.0 |
| 3 | 8.55 | 140 | 9.05 | 0.50 | 5.8 |
| 4 | 6.80 | 129 | 7.52 | 0.72 | 10.6 |
| 5 | 7.76 | 128 | 8.50 | 0.74 | 9.5 |

The above-tabulated data clearly shows the improvement realized by employing the process of the present invention for manufacturing concrete pipe and like products. For example, it will be observed that Sample No. 1 has a compressive strength which is 56% higher than the compressive strength for counterpart Sample No. 4 made under the same conditions, but with a standard vibrator ring. Sample No. 2 has almost a 19% improvement in compressive strength compared to its counterpart Sample No. 5 processed under the same conditions, but without the magnetic vibrator ring. Moreover, visual inspection of the interior surface of the bell end of the as formed pipe samples revealed that smoother, more uniform textures for Samples Nos. 1 and 2 were evident. Sample No. 3 made from a "dry" concrete mixture even possessed a much better test strength than did the comparative samples made from the recommended concrete mixture.

With respect to the boiling water absorption tests, again it will be observed that the inventive Samples 1 and 2 each absorbed about 58% less water than did their comparative counterpart Samples 4 and 5. This reduction in water absorption is consistent with the increased density (unit weight) recorded for the samples as displayed in Table No. 2.

The present invention can be applied to any conventional concrete mixture of Portland cement, or other cementitious material including polymeric and polymeric-extended cementitious mixtures. Aggregate usage also is conventional. The concrete products optionally may be reinforced with steel or other metal reinforcing bars in conventional fashion and improvements in the resulting concrete product attained in accordance with the precepts of the present invention. Also, it will be appreciated that a variety of concrete products in addition to concrete pipe products will be of improved quality by being processed in accordance with the present invention. Finally, it will be appreciated that ready implementation of the invention in drycast processing, where only vibration is employed, can be accomplished in accordance with the precepts of the present invention.

What is claimed is:

1. A concrete pipe forming apparatus including a mold containing a lower curing pallet, a platform for supporting said mold, a vibrator table having vibration means and drive means for rotating said table, and a vibrator ring attached to said vibrator table for transmitting vibration and rotary movement from said vibrator table to said lower curing pallet, the improvement comprising said vibrator ring having selectively engageable means to rigidly connect said vibrator ring to said curing pallet when said vibration means is activated.

2. The apparatus of claim 1 wherein said selectively engageable means comprises electromagnet means.

3. The apparatus of claim 2 wherein said electromagnet means are disposed within said vibrator ring for selectively rendering said vibrator ring magnetic.

4. The apparatus of claim 3 wherein said vibrator ring has downwardly projecting legs for attachment to said vibrator turntable.

5. The apparatus of claim 1 wherein said vibrator ring has drive slots for receiving legs which project from said curing pallet.

6. The apparatus of claim 1 wherein said vibrator ring has downwardly projecting legs for attachment to said vibrator turntable.

7. In a method for forming a concrete pipe which includes casting concrete material in a pipe mold containing a lower curing pallet, vibrating and rotating a vibrator table having vibration means and rotary drive means and transmitting vibration and rotation from the table to the pallet using a vibrator ring attached to said vibrator table, the improvement comprising:

rigidly connecting said vibrator ring and said lower curing pallet with selectively engageable means when said vibration means and said drive means are activated; and disengaging said engageable means thereafter.

8. The method of claim 7 wherein said vibrator ring is connected via upstanding legs to said vibrator table.

9. The method of claim 7 wherein said vibrator ring is rigidly connected to said lower curing pallet with electromagnet means which comprise said selectively engageable means, and said step of rigidly connecting the ring to the pallet further comprises energizing said electromagnet means.

10. The method of claim 9 further comprising disposing said electromagnet means within said vibrator ring for selectively causing said vibrator ring to be magnetic.

11. The method of claim 10 wherein said vibrator ring is connected via upstanding legs to said vibrator table.

* * * * *